US007140977B2

(12) United States Patent
Atkins, Sr.

(10) Patent No.: US 7,140,977 B2
(45) Date of Patent: Nov. 28, 2006

(54) GOLF CLUB HEAD

(75) Inventor: Clyde D. Atkins, Sr., Conneaut, OH (US)

(73) Assignee: Atkins Technology, Inc., Scottsdale, AZ (US)

( * ) Notice: Subject to any disclaimer, the term of this patent is extended or adjusted under 35 U.S.C. 154(b) by 0 days.

(21) Appl. No.: 10/859,939

(22) Filed: Jun. 4, 2004

(65) Prior Publication Data

US 2005/0272523 A1 Dec. 8, 2005

(51) Int. Cl.
*A63B 53/04* (2006.01)
*A63B 53/06* (2006.01)

(52) U.S. Cl. ..... 473/346; 473/333

(58) Field of Classification Search ..... 473/324–350
See application file for complete search history.

(56) References Cited

U.S. PATENT DOCUMENTS 3,637,218 A * 1/1972 Carlino ..... 473/325
5,464,211 A 11/1995 Atkins, Sr.
5,547,427 A * 8/1996 Rigal et al. ..... 473/345
6,652,391 B1 * 11/2003 Kubica et al. ..... 473/345
6,800,038 B1 * 10/2004 Willett et al. ..... 473/329
6,824,475 B1 * 11/2004 Burnett et al. ..... 473/329
6,872,148 B1 * 3/2005 Lee ..... 473/131

FOREIGN PATENT DOCUMENTS

JP 07231957 A * 9/1995
JP 2004033536 A * 2/2004

* cited by examiner

*Primary Examiner*—Eugene Kim
*Assistant Examiner*—Alvin A. Hunter, Jr.
(74) *Attorney, Agent, or Firm*—Meschkow & Gresham, PLC

(57) ABSTRACT

A golf club head comprises a front striking plate that in turn comprises a front striking surface, a rear surface, and a first boss generally centrally located on and attached to the rear surface. A rear body section is fixedly coupled to the front striking plate. A longitudinal member is adjustably coupled to the rear body section and has a first end configured for pivotal movement in engagement with the first boss. The longitudinal member applies a force of compression onto the rear surface of the striking plate.

19 Claims, 4 Drawing Sheets

GOLF CLUB HEAD

FIELD OF THE INVENTION

This invention relates generally to golf clubs, and more particularly, to golf club heads commonly referred to as "woods" including clubs known as "drivers". More particularly, this invention applies to such clubs that comprise a hollow, flat faced bulbous shape.

BACKGROUND OF THE INVENTION

Golf clubs of the type known as "woods" are commonly used in the sport of golf. The heads of such clubs may be made of metal (e.g. stainless steel), high-tech plastic, or reinforced plastic. If made of metal, these heads are sometimes referred to as "metal woods". For purposes of this description, the use of the term "wood" shall be intended to include driving clubs made of metal, plastic, graphite, and the like.

Metal woods present numerous options to the golf club manufacturer to provide customized weight and balance for a golfer, whether amateur or professional. It is not uncommon for a golfer, in order to improve the accuracy of their game, to seek a club with an enlarged "sweet spot" (i.e. that area on the striking face of a club that, upon impact with the ball, will send the ball on a preferred trajectory, without hooking or slicing). In addition, most golfers prefer a golf club head that is generally lightweight but configured to perform as if a significant portion of its weight were located behind the sweet spot. Hollow metal heads may be engineered to incorporate these desired features into a given golf club.

A problem associated with some clubs is that the substantially flattened striking surface supported around its edge acts like a drum when struck. That is, the relatively thin metal striking plate is free to deflect upon impact and then rebound. The nature and direction of the rebound depends on the location of the point of impact on the striking surface and can affect the speed, rotation, and direction of the golf ball as it leaves the club-head, thereby affecting the trajectory of the ball.

U.S. Pat. No. 5,464,211 issued Nov. 7, 1995 and entitled "GOLF CLUB HEAD" attempts to solve this problem by providing a rigid, unyielding striking surface. A striking surface having an inner surface and an outer surface is coupled to an opposed rear portion to form the golf club head body. A partially threaded stem having an externally threaded proximal portion and a broadened distal portion with a substantially flat surface threadably engages an internally threaded cylinder within the head body such that when the stem is threaded into the head body, the distal flat surface of the broadened portion of the stem applies a compressive force to the inner surface of the striking face. The amount of force may be adjusted by turning the threaded portion of the stem. In this manner, the impact zone on the striking face of the club is rendered more rigid.

Unfortunately, the above described apparatus has certain disadvantages. For example, due to the rigid design of the jackscrew/stem assembly including the broadened distal end, and because the ball is not always struck at a location on the striking surface corresponding to the center of the broadened distal end of the stem, significant bending stresses are transmitted to the entire stem assembly eventually damaging the assembly with repeated use.

Accordingly, it would be desirable to provide an improved golf club head that provides a more rigid, unyielding striking surface or impact zone. It would further be desirable that the improved golf club head be sturdier and more reliable than prior art devices. Furthermore, other desirable features and characteristics of the present invention will become apparent from the subsequent detailed description of the invention and the appended claims, taken in conjunction with the accompanied drawings and the background of this invention.

BRIEF SUMMARY OF THE INVENTION

According to an aspect of the invention, there is provided a striking plate for use on a golf club head. The striking plate comprises a front striking surface and a rear surface. A boss is generally centrally located and attached to the rear surface, and a recess is substantially centrally located in the boss.

According to a further aspect of the invention, there is provided a golf club head, comprising a front striking plate, the striking plate comprising a front striking surface and a first boss generally centrally located on and attached to the rear surface. A rear body section is fixedly coupled to the front striking plate. A longitudinal member is adjustably coupled to the rear body and has a first end configured for pivotal movement in engagement with the first boss. The longitudinal member applies a force of compression onto the rear surface of the striking plate.

According to a still further aspect of the invention, there is provided a golf club comprising a front striking plate that comprises a front striking surface and a first boss generally centrally located and attached to the rear surface. A rear body section is fixedly coupled to the front striking plate. A longitudinal member is adjustably coupled to the rear body and has a first end configured for pivotal movement in engagement with the first boss. The longitudinal member applies a force of compression onto the rear surface of the striking plate, and a gripping shaft is fixedly coupled to the rear body section.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
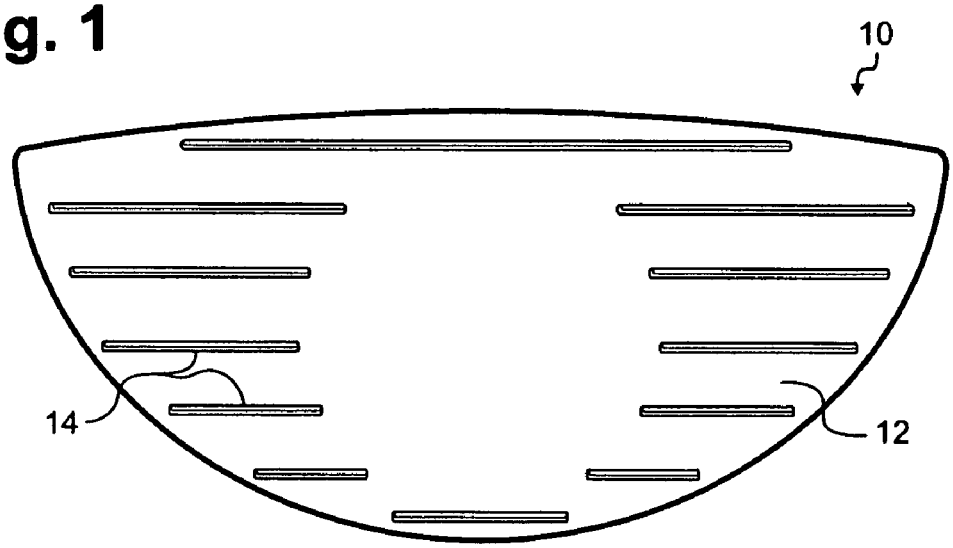
FIGS. 1, 2, 3, and 4 are front surface, rear surface, top, and side views respectively of a golf club striking plate in accordance with the present invention.
Figure 2:
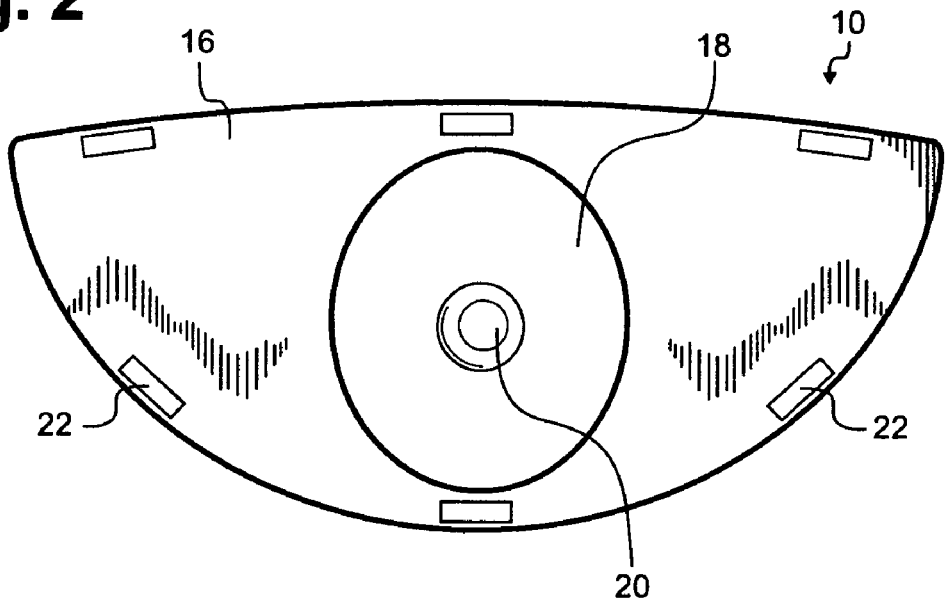
Figure 3:
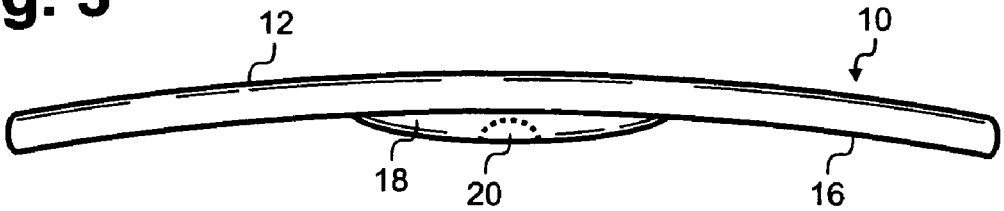
Figure 4:
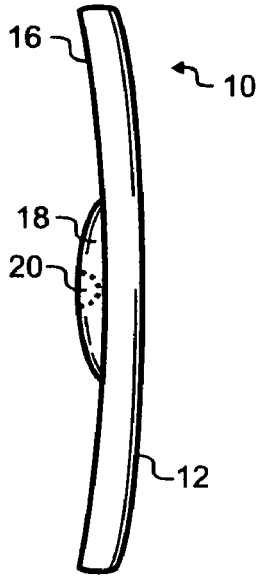

FIGS. 1, 2, 3, and 4 are front, rear, top, and side views respectively of a novel striking plate 10 for use on a golf club head in accordance with the present invention. As can be seen in FIGS. 3 and 4, striking plate 10 may be slightly curved and have a generally flat striking surface 12 shown in FIG. 1. Striking surface 12 may be provided with a plurality of grooves 14 shown as horizontal, in FIG. 1; however, it should be clear than any desired pattern of grooves may be utilized.

Striking plate 10 has a generally flat rear surface 16 except for a generally centrally located raised portion or boss 18 having a generally centrally located, spherical concavity or recess 20 therein. While boss 18 is shown as being generally circular, other shapes could be utilized.

Boss 18 may be formed integrally with the remainder of striking plate 10. Thus, by way of example, striking plate 10 may have a thickness of approximately 0.09 inches at its flat, peripheral regions and increase to approximately 0.18 inches in the area of boss 18. Recess 20 may have a depth of approximately 0.09 inches and a diameter of approximately 0.5 inches. Finally, if desired, a plurality of locating bosses 22 (shown only in FIG. 2 for clarity) may be provided to assist in the placement of striking plate 10 when it is attached to the rear portion 24 (FIG. 5) of the club head as, for example, by welding.

Figure 5:
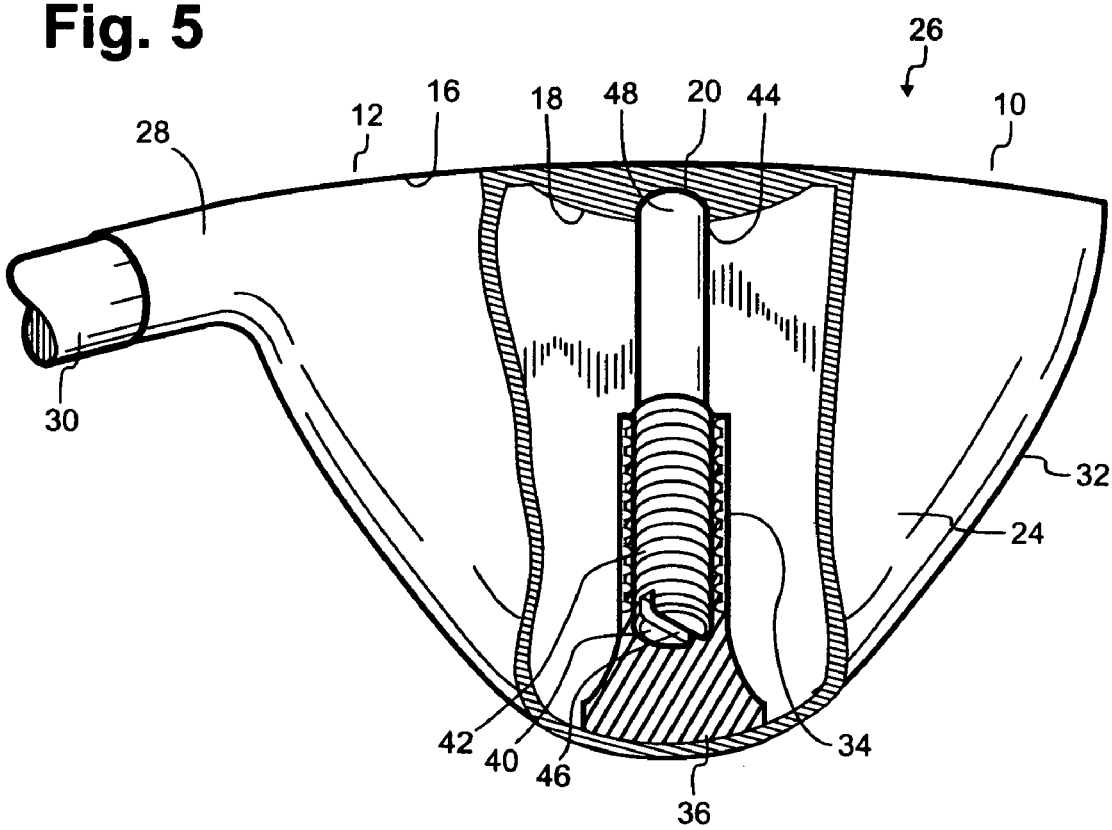
FIG. 5 is a top, partially cut-away view of a golf club head utilizing the striking plate shown in FIGS. 1, 2, 3, and 4 in accordance with the present invention.
Figure 7:
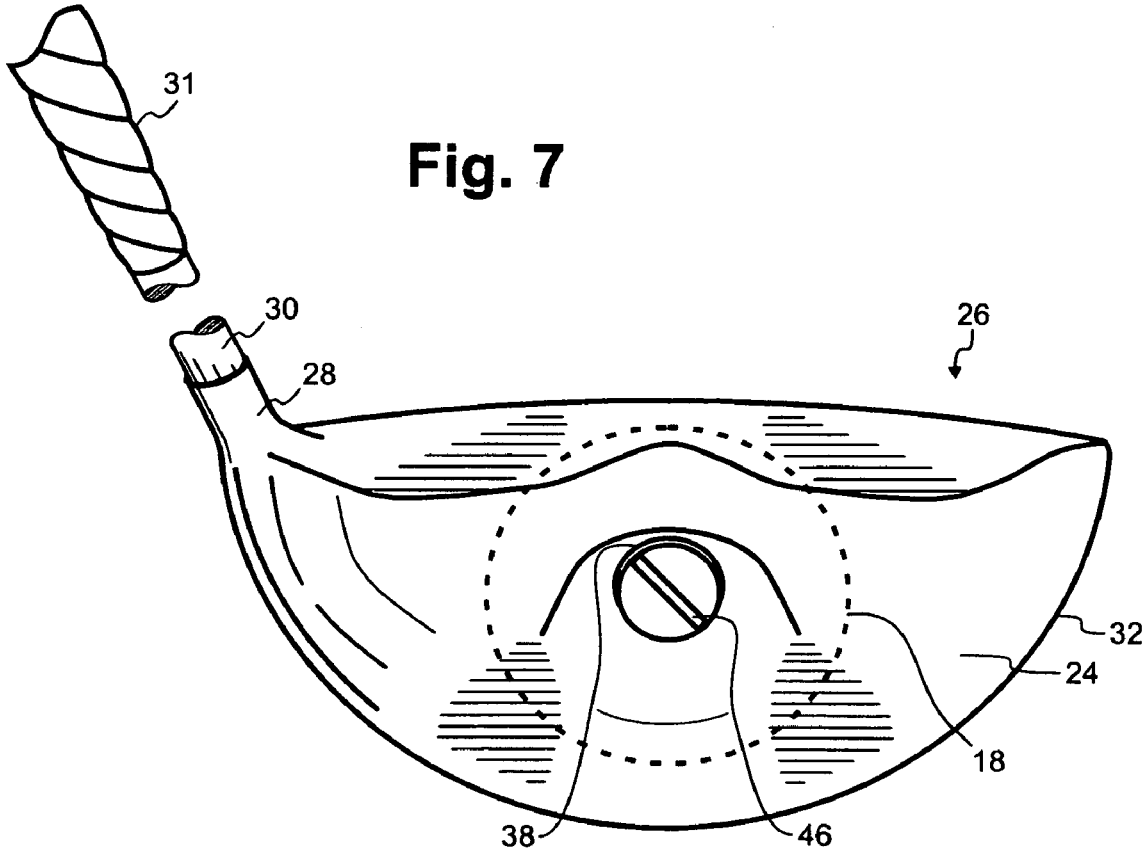
FIGS. 7 and 8 are rear and front views respectively of the golf club head shown in FIG. 5.
Figure 8:
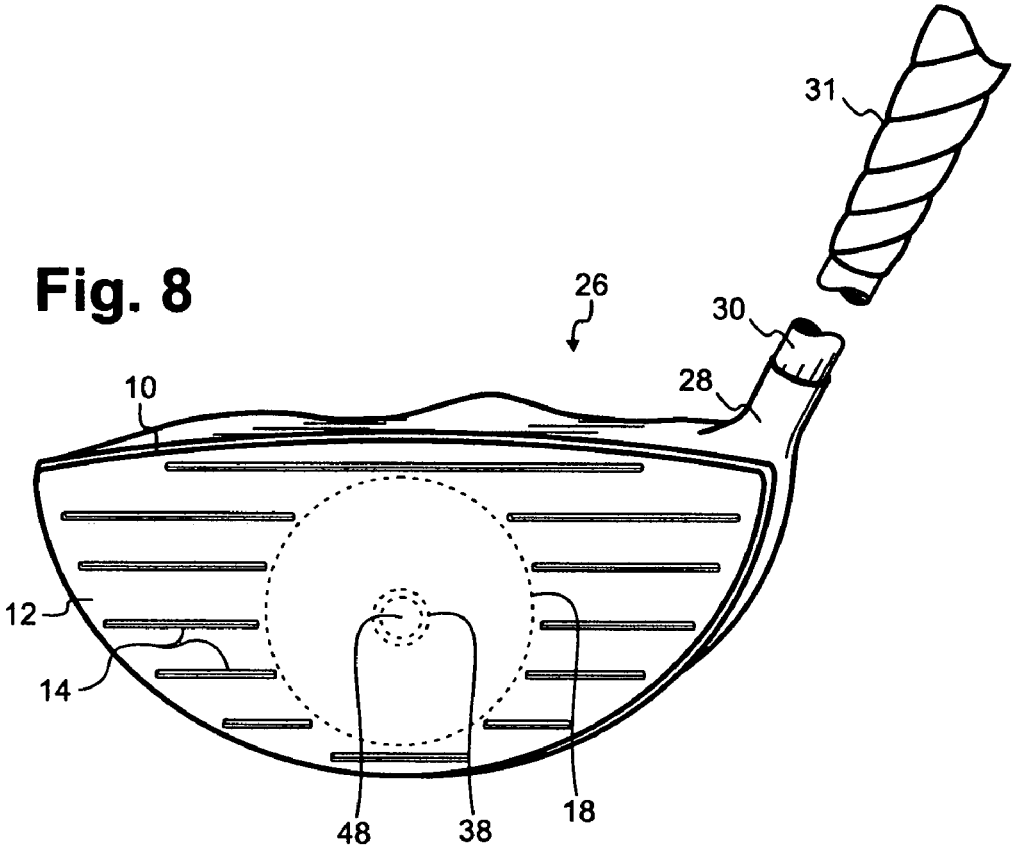

FIGS. 5, 7, and 8 are top cutaway, rear, and front views respectively of a golf club head 26 in accordance with the present invention. Club head 26 is adapted at 28 with a housel fitted to an elongated shaft 30 terminating with a gripping portion 31 (shown only in FIG. 8) that is held by a player using the golf club. Striking plate 10 is attached (e.g. welded) to a generally hollow, bulbous rear section 32 to form the golf club head. Both striking plate 10 and rear section may be made of stainless steel or other suitable material as previously mentioned. Furthermore, while the construction of the golf club head has been described as the joining of a striking plate 10 to a rear bulbous section 24, it should be clear that other assembly techniques may be utilized without department from the spirit and scope of the invention.

Figure 6:
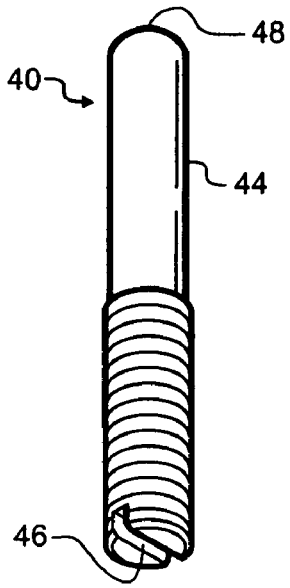
FIG. 6 is a plan view of a jackscrew suitable for use with the golf club head shown in FIG. 5.

A belled, internally-threaded tube 34 is fixedly coupled to a rear section 32 as is shown at 36 and is accessible through opening 38. Internally threaded tube 36 is configured to threadably receive a jackscrew 40 therein through opening 38. Jackscrew 40 comprises a threaded portion 42 and a stem 44 (FIG. 6) having a rounded or hemispherical tip 48 that is matingly received within recess 20. Jackscrew 40 may be turned by means of, for example a screwdriver inserted into slot 46. If jackscrew 40 is rotated clockwise, tip 48 is brought into contact with the surface of recess 20. Counter-clockwise rotation of jackscrew 40 will cause tip 48 to be extracted from recess 20.

After tip 48 is brought into initial contact with the inner surface of recess 20, further rotation of jackscrew 40 produces a force against the inside surface 16 of striking plate 10, and an equal and opposite force drives tube 34 against the inside wall of the rear section 32, placing the entire striking plate and tube system into compressive loading, which we refer to as a pre-stressed condition. This pre-stressing involves the skin of the club head as well as the striking plate, placing the skin in tension to balance the force being applied to the striking plate and belled tube system. The overall effect is to produce a club head that is more rigid than are those of the prior art, especially in the reaction of the club to impact on the face thereof. In this manner, the "sweet spot" of the club head has been substantially enlarged.

Figure 9:
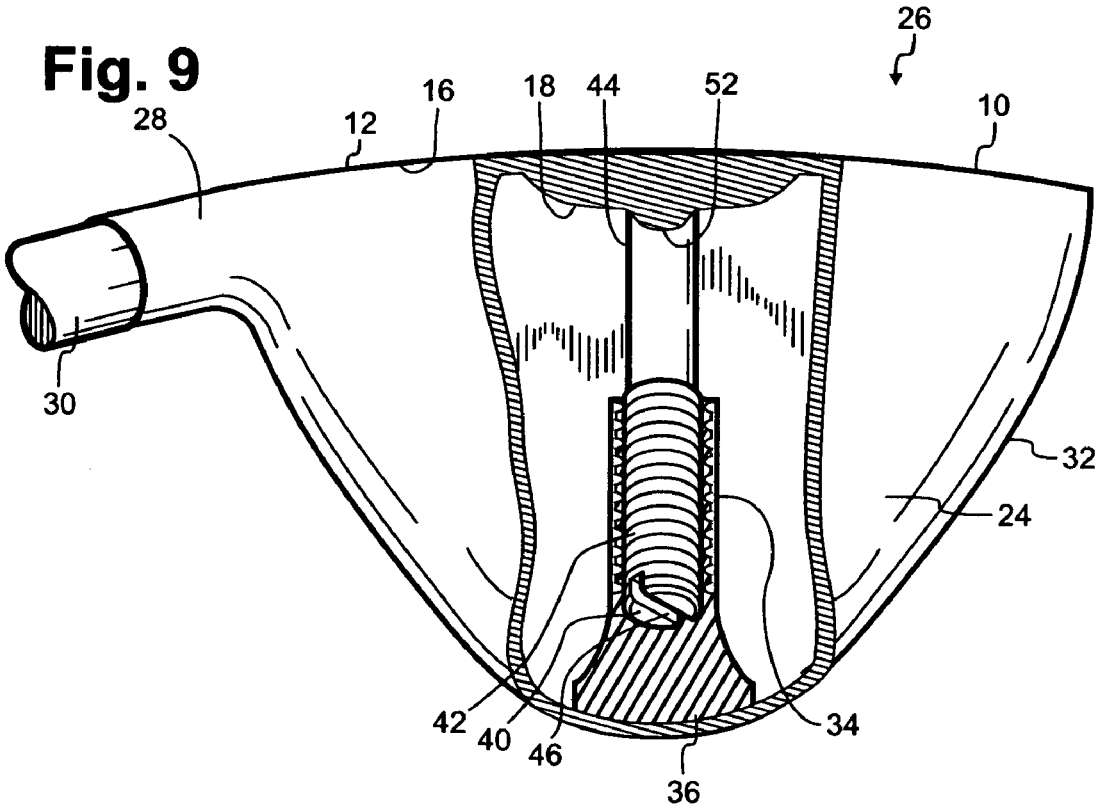
FIG. 9 is partial cutaway view of a golf club head in accordance with a second embodiment of the present invention.

FIG. 9 is a top, cutaway view of an alternate embodiment of a golf club head in accordance with a present invention wherein like reference numerals denote like elements. In this embodiment, a second raised portion or boss 50 (e.g. generally hemispherical) is located substantially centrally on boss 18. The tip of stem 44 includes a concavity 52 (e.g. generally hemispherical) for matingly receiving boss 50 in order to apply a force of compression on striking plate 10 as above described.

Thus, there has been provided an improved golf club that provides a more rigid, unyielding striking surface or impact zone. Jackscrew 40 and boss 18 generally have mating convex and concave hemispheres (or vice versa). Boss 18 and striking plate 10 are permitted to pivot with respect to tip 48 of stem 44. Bending stresses and torque that result when a ball is struck result in a pivoting of striking plate 10. Through this pivoting, these stresses are not transmitted to stem 44 and threaded section 42 of jackscrew 40. Therefore such stresses are not transmitted to internally threaded tube 34. This results in a sturdier golf club head.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient roadmap for implementing an exemplary embodiment of the invention, it being understood that various changes may be made in the function and arrangement of elements without departing from the scope of the invention as set forth in the appended claims.

What is claimed is:

1. A golf club head, comprising:

a front striking plate comprising:

a front striking surface;

a rear surface;

a boss generally centrally and rigidly coupled to said rear surface; and a substantially spherically curved recess substantially centrally located in said boss;

a rear body section fixedly coupled to said front striking plate; and a jackscrew adjustably coupled to said rear body section and comprising:

a substantially spherically curved first end configured to mate with and engage said recess so as to allow pivotal movement of said striking plate with respect to said first end; and a second end configured to apply an outward force to said rear surface.

2. A golf club head according to claim 1 wherein said jackscrew is threadably adjustable within said rear body section.

3. A golf club head according to claim 1 wherein said second end is accessible from an exterior of said rear body section.

4. A golf club head according to claim 1 further comprising an internally threaded tube fixedly coupled to an interior of said rear body section.

5. A golf club head according to claim 4 wherein said jackscrew is an externally threaded jackscrew configured to threadably engage said internally threaded tube.

6. A golf club head according to claim 1 wherein said jackscrew comprises:

a threaded portion; and a stem configured to pivotally engage said boss.

7. A golf club head according to claim 1 wherein:

said boss has a substantially centrally located recess; and said tip of said stem is convex and configured to mate with said recess.

8. A golf club head according to claim 1 wherein said boss is integrally formed with said striking plate.

9. A golf club head according to claim 1 wherein said boss is substantially circular.

10. A golf club head according to claim 1 wherein said rear surface is substantially flat proximate said boss.

11. A golf club head according to claim 1 wherein said boss increases in thickness radially inward from a periphery of said boss.

12. A golf club, comprising:

a front striking plate comprising:

a front striking surface;

a rear surface; and a boss generally centrally and rigidly coupled to said rear surface; and a substantially spherically curved recess substantially centrally located in said boss;

a rear body section fixedly coupled to said front striking plate;

a jackscrew adjustably coupled to said rear body section and comprising:

a substantially spherically curved first end configured to mate with and engage said recess so as to allow pivotal movement of said striking plate in about said first end; and a second end configured to apply an outward force to said rear surface; and a gripping shaft fixedly coupled to said rear body section.

13. A golf club according to claim 12 wherein:

said golf club further comprises an internally threaded tube fixedly coupled to an interior of said rear body section; and said jackscrew comprises an externally threaded screw member configured to threadably engage said internally threaded tube, said screw member being accessible from an exterior of said rear body section.

14. A golf club according to claim 12 wherein said boss is integrally formed with said striking plate.

15. A golf club according to claim 12 wherein said boss increases in thickness inward from a periphery of said boss toward a periphery of said recess.

16. A golf club head according to claim 1 wherein said second end is coupled to said rear body section.

17. A golf club head, comprising:

a front striking plate comprising:

a front striking surface;

a rear surface;

a first boss generally centrally and rigidly coupled to said rear surface; and a curved second boss substantially centrally located on said first boss;

a rear body section fixedly coupled to said front striking plate; and a jackscrew adjustably coupled to said rear body section and comprising:

a curved first end configured to mate with and engage said second boss so as to allow pivotal movement of said striking plate with respect to said first end; and a second end configured to apply an outward force to said rear surface.

18. A golf club head according to claim 17 wherein:

said second boss is convex; and said first end is concave.

19. A golf club head according to claim 17 wherein:

said second boss has a substantially spherical curvature; and said first end has a substantially spherical curvature complimentary to said second boss.

* * * * *